US005726697A

United States Patent [19]

Shimoda

[11] Patent Number: 5,726,697

[45] Date of Patent: Mar. 10, 1998

[54] INK JET RECORDING APPARATUS HAVING AN OPTIMALLY-DIMENSIONED INK JET HEAD STRUCTURE

[75] Inventor: Junji Shimoda, Chigasaki, Japan

[73] Assignee: Canon Kabushiki Kaisha, Tokyo, Japan

[21] Appl. No.: 555,502

[22] Filed: Nov. 8, 1995

Related U.S. Application Data

[63] Continuation of Ser. No. 136,406, Oct. 15, 1993, abandoned, which is a continuation of Ser. No. 716,841, Jun. 17, 1991, abandoned.

[30] Foreign Application Priority Data

Jun. 15, 1990 [JP] Japan ..... 2-157002

[51] Int. Cl.[6] ..... B41V 2/05

[52] U.S. Cl. ..... 347/62; 347/65

[58] Field of Search ..... 347/65, 63, 62, 347/56

[56] References Cited

U.S. PATENT DOCUMENTS

| | | | |
|---|---|---|---|
| 3,984,844 | 10/1976 | Tanno | 346/76 PH |
| 4,313,124 | 1/1982 | Hara | 347/57 |
| 4,334,234 | 6/1982 | Shirato et al. | 347/65 |
| 4,338,611 | 7/1982 | Eida et al. | 347/63 |
| 4,345,262 | 8/1982 | Shirato et al. | 347/57 |
| 4,463,359 | 7/1984 | Ayata et al. | 347/57 |
| 4,723,129 | 2/1988 | Endo et al. | 347/56 |
| 4,723,136 | 2/1988 | Suzumara | 347/65 |
| 4,752,787 | 6/1988 | Matsumoto et al. | 347/65 |
| 4,897,674 | 1/1990 | Hirawasa | 347/65 |
| 4,914,562 | 4/1990 | Abe | 347/63 |
| 5,204,689 | 4/1993 | Shirato | 347/62 |

FOREIGN PATENT DOCUMENTS

| | | | |
|---|---|---|---|
| 55-109672 | 8/1980 | Japan | B41J 3/04 |
| 55-132276 | 10/1980 | Japan | B41J 3/04 |
| 60-008074 | 1/1985 | Japan | B41J 3/04 |
| 64-087356 | 3/1989 | Japan | B41J 3/04 |

*Primary Examiner*—Joseph W. Hartary

*Attorney, Agent, or Firm*—Fitzpatrick, Cella, Harper & Scinto

[57] ABSTRACT

To increase ink jet recording head responsivity and/or decrease recording head size, an ink jet recording apparatus is provided having plural liquid passages, each having an ejection outlet through which a droplet of liquid is ejected at the end of the liquid passage. Each of the passages is supplied with ink from only the other end. A common ink chamber contains the ink, and communicates with the liquid passages at different supply ports of the passages. Electrothermal transducer elements each have a planar heat generating element provided in each of the liquid passages, the electrothermal transducers being supplied with electric signals to produce a change in state of the ink involving the formation of a bubble in the liquid passage by thermal energy. A minimum distance La between each of the heat generating elements and the corresponding ejection outlet is between about 90 and 130 microns, and a minimum distance Lb between each of the heat generating elements and the corresponding supply port is not more than about 110 microns. La and Lb are selected such that La is greater than Lb. Further, a driving circuit energizes the heat generating elements, this circuit supplying the electric signals so that adjacent ones of the heat generating elements are driven with a time difference.

11 Claims, 6 Drawing Sheets

INK JET RECORDING APPARATUS HAVING AN OPTIMALLY-DIMENSIONED INK JET HEAD STRUCTURE

This application is a continuation of application Ser. No. 08/136,406, filed Oct. 15, 1993, now abandoned, which is a continuation of application Ser. No. 07/716,841, filed Jun. 17, 1991, now abandoned.

FIELD OF THE INVENTION AND RELATED ART

The present invention relates to an ink jet recording apparatus usable with an information processing apparatus as an output terminal or an ink jet recording apparatus functioning as a printer unified with an information processing apparatus, more particularly to an ink jet recording apparatus usable with personal computer, wordprocessor, copying machine, facsimile machine or the like. Further particularly, the present invention relates to an ink jet recording apparatus using an electrothermal transducer to produce thermal energy contributable to ejection of the ink in accordance with image information.

An ink jet recording apparatus wherein a liquid droplet is ejected by creation of a bubble corresponding to instantaneous state of change of the liquid by the thermal energy produced by an electrothermal transducer is disclosed in U.S. Pat. No. 4,723,129. The U.S. Patent discloses a simultaneous drive system wherein plural electrothermal transducers are simultaneously driven and a non-simultaneous driving system wherein the plural electrothermal transducers are sequentially driven with phase difference to effect recording in an inclined fashion. The similar disclosure is made in Japanese Laid-Open Patent Application No. 109672/1980. The U.S. Patent also discloses what is called a time sharing driving system for a great number of electrothermal transducers.

However, in a recording apparatus using thermal energy, which has been put into practice, the above described simultaneous driving system has been considered to be most preferable, since it is advantageous in that the high speed recording is possible.

Therefore, in most of the proposals in connection with the ink jet recording system, it is a premise that the driving signals are simultaneously supplied to the electrothermal transducers in accordance with recording signals.

U.S. Pat. No. 4,334,234 discloses that $L1/L2 \leqq 1$, where L1 is a minimum distance from the ejection outlet to the heat generating element of the electrothermal transducer, and L2 is a distance from the portion of the heat generating element determining the distance L1 to the internal wall of the common liquid chamber (the portion reversing a back wave). The invention disclosed there is intended to avoid the influence of the back wave since otherwise the response frequency is decreased by the influence of the back wave. Therefore, the invention disclosed there is directed to the structure of the recording head and the common liquid chamber.

Japanese Laid-Open Patent Application No. 132276/1980 (Japanese Patent Application Publication 31945/1984) discloses a recording head having a single passage, wherein the reference is made to the ink supply port for supplying the ink from the liquid chamber to the liquid passage having the electrothermal transducer. However, the invention disclosed there notes only a distance x from the ink supply port to the heat generating element having a length l and a distance L between the ejection outlet and the ink supply port, and it discloses an embodiment wherein the distance L is not less than 1 mm and not more than 5 mm. The invention disclosed in the Japanese Publication is directed to the remaining bubbles having stemmed from the gases resolved in the liquid.

U.S. Pat. No. 4,338,611 discloses a recording head satisfying $1/100 \leqq a/b \leqq ½$, where b is a minimum distance between an ink supply port of a liquid passage and a heat generating element, and a is a minimum distance from the ejection outlet of the liquid passage to the heat generating element. The U.S. Patent teaches that the direction of the ejection is stabilized, the response frequency (the number of ejected droplets per unit time) is increased, and the production of satellite droplets can be prevented. The U.S. Patent negates a>b, but the driving conditions are not disclosed, and therefore, it is a simultaneous driving system which is well known. U.S. Pat. No. 4,723,136 discloses a recording head having a flow resistance element between the heat generating element and the ink supply port for the passage, and further it discloses other ink supply passages.

U.S. Pat. No. 4,897,674 discloses a recording apparatus wherein $L2 \leqq L1 \leqq 5\ L2$ are satisfied, where L1 is a distance between an ejection outlet and an ink supply port, and L2 is a distance from the ejection outlet to an upstream end of the heat generating element. The U.S. Patent discloses that a partial wall is formed in the common liquid chamber for the purpose of stabilizing the ejection speed, and that the cross-sectional area decreases toward the ejection outlet. Such a cross-sectional area is also disclosed in U.S. Pat. No. 4,752,787.

In the conventional recording head, the length of the passage is generally long.

U.S. Pat. No. 4,338,611 discloses plural liquid passages communicating with a common liquid chamber, and teaches a certain range. However, the further improvement is desired.

It has been found that the recording frequency at which the recording liquid droplets can be formed, that is, the printable frequency decreases with the increase of the number of electrothermal transducer elements.

More particularly, the number of liquid passages increases to 64, 128 or 256, for example, the printable frequency decreases.

SUMMARY OF THE INVENTION

Accordingly, it is a principal object of the present invention to provide an on-demand type ink jet recording apparatus capable of good recording operation.

It is another object of the present invention to provide an ink jet recording apparatus capable of high frequency recording.

It is a further object of the present invention to provide an ink jet recording apparatus capable of stabilizing the quantities of the ejected liquid droplets.

According to an aspect of the present invention, there is provided an ink jet recording apparatus, comprising: a plurality of liquid passages each having an ejection outlet through which a droplet of the liquid is ejected, at an end of the liquid passage, and each of the passages being supplied with ink only from the other end; a common ink chamber for containing the ink, with which said liquid passages communicate at different supply ports of said passages; electrothermal transducer elements each having a planar heat generating element in each of said liquid passages, said electrothermal transducer element being supplied with electric signal to produce state change of the ink including formation of a bubble in the liquid passage due to thermal energy, wherein a minimum distance La between each of the heat generating elements and the corresponding ejection outlet is not less than 90 microns and not more than 130 microns, a minimum distance Lb between each of the heat generating elements and the corresponding supply port is not more than 110 microns, and the distances La and Lb satisfy La>Lb; a driving circuit for energizing said heat generating elements, said driving circuit supplying the electric signals so that adjacent ones of said heat generating elements are driven with a time difference.

According to a further aspect of the present invention, there is provided an ink jet recording apparatus, comprising: a plurality of liquid passages each having an ejection outlet through which a droplet of the liquid is ejected, at an end of the liquid passage, and each of the passages being supplied with ink only from the other end; a common ink chamber for containing the ink, with which said liquid passages communicate at different supply ports of said passages; electrothermal transducer elements each having a planar heat generating element in each of said liquid passages, said electrothermal transducer element being supplied with electric signal to produce state change of the ink including formation of a bubble in the liquid passage due to thermal energy, wherein said heat generating elements each have a heat generating area which is not less than 3390 micron$^2$ and not more than 4190 micron$^2$, a minimum distance La between each of the heat generating elements and the corresponding ejection outlet is not less than 90 microns and not more than 130 microns, a minimum distance Lb between each of the heat generating elements and the corresponding supply port is not more than 110 microns, and the distances La and Lb satisfy La>Lb; a driving circuit for energizing said heat generating elements, said driving circuit supplying the electric signals so that adjacent ones of said heat generating elements are driven with a time difference.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 8:
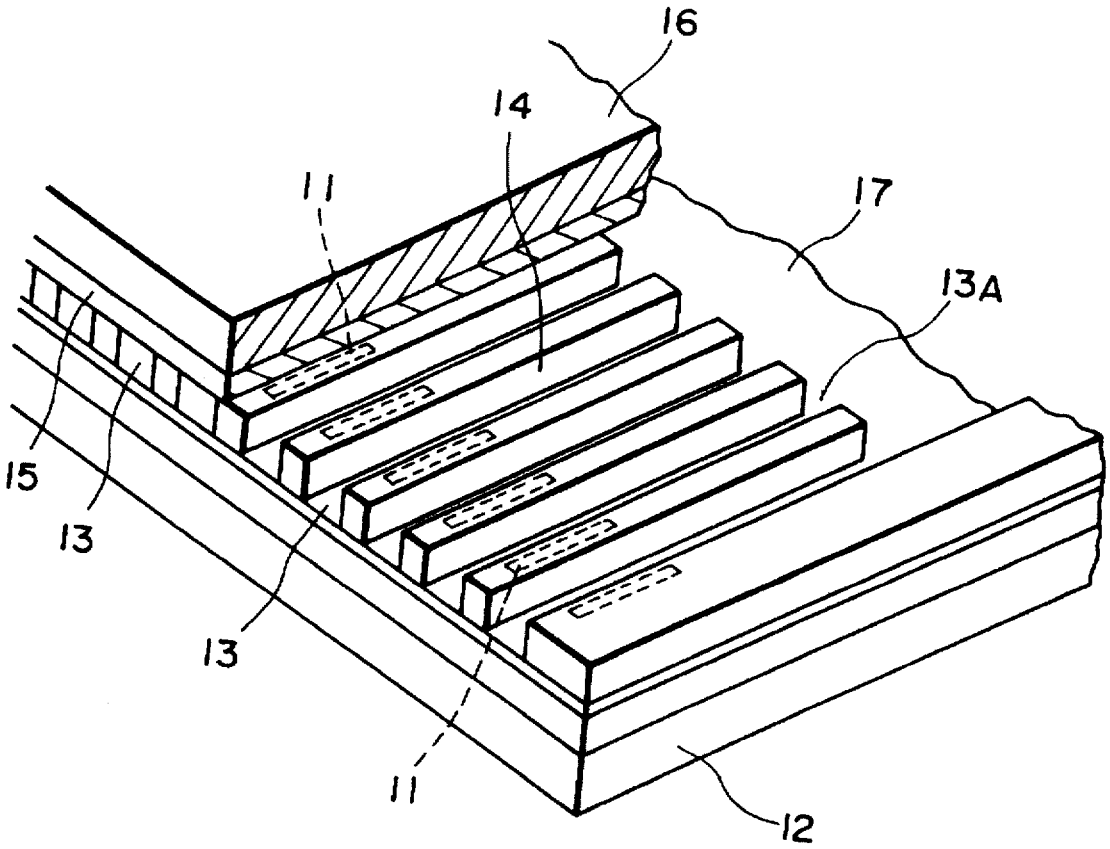
FIG. 8 is a sectional view of a recording head according to the present invention.

FIG. 8 is a perspective view of an ink jet recording head to which the present invention is applicable. Designated by a reference numeral 11 is a heat generating portion (heat generating element) of an electrothermai transducer producing thermal energy contributable to ejection of the recording liquid (ink) by creating a bubble, when the electrothermal transducer is supplied with electric energy. The heater 11 is formed on a substrate 11 through the process similar to the semiconductor manufacturing process. The recording head further comprises ejection outlets (orifices) 13 through which the recording liquid is ejected, ink passages (nozzles) 14 communicating with the respective ejection outlets 13, and ink passage constituting member 15 for constituting the ejection outlets and the ink passages 14.

The recording head further comprises a top plate 16, a common liquid chamber 17 commonly communicating with the ink passages 14, and is effective to accommodate the ink supplied from an unshown ink supply source.

Figure 3:
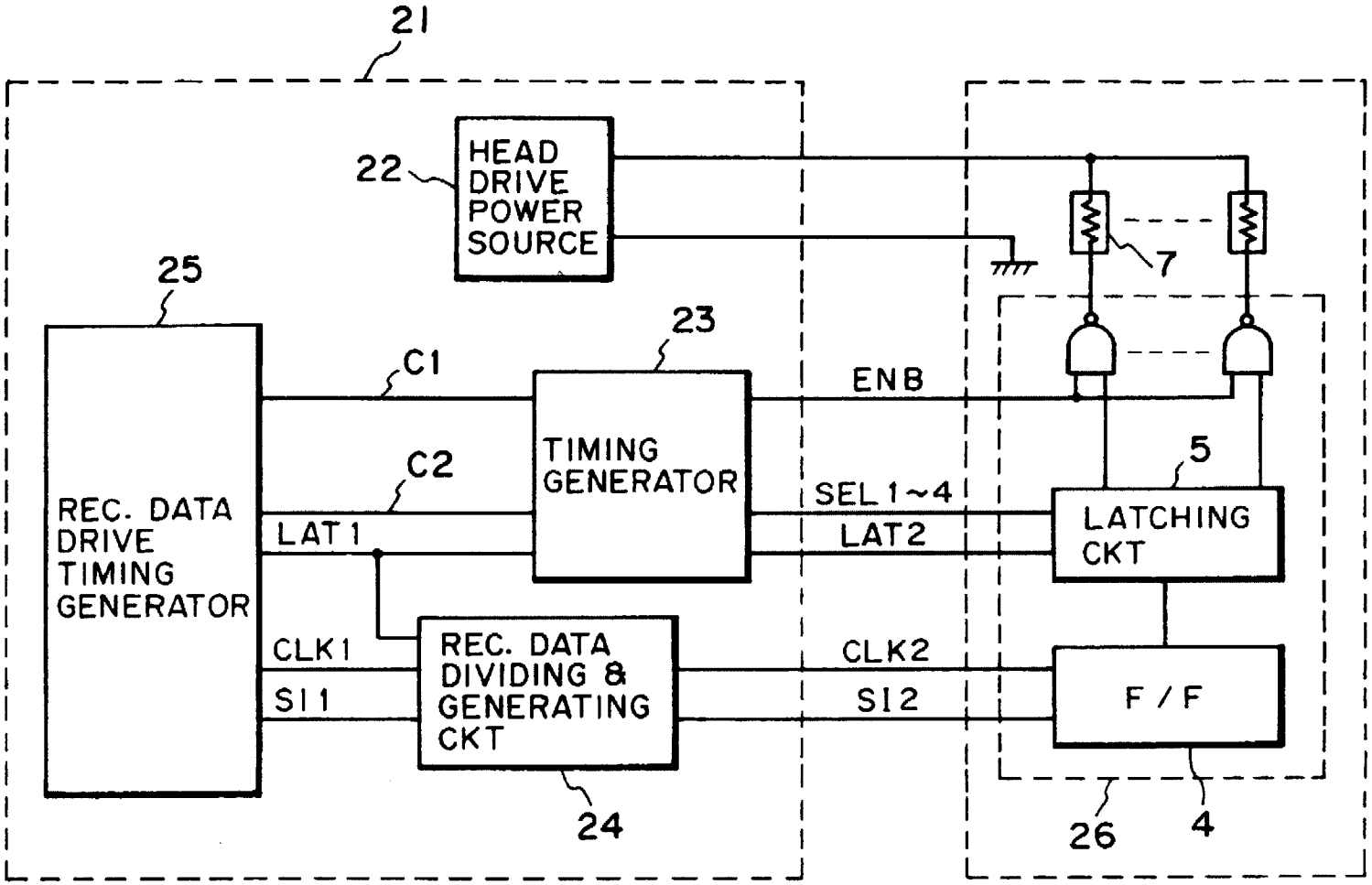
FIG. 3 is a block diagram of a control system for the apparatus according to an embodiment of the present invention.

FIG. 3 is a block diagram of an example of a drive control system for the ink jet recording head having a structure shown in FIG. 8. The control system comprises a head driving circuit 21, a head driving source 22, a timing generating circuit 23, a recording data dividing circuit 24, a recording data drive timing generating circuit 25. The timing generating circuit 23 is responsive to the data to be recorded and control signals C1 and C2 from the drive timing generating circuit 25 to generate a pulse width setting signal ENB and selection signals SEL1, SEL2, SEL3 and SEL4 for selecting the latching positions of the input record data to select the electrothermal transducer elements to be driven and to produce a latching signal LAT2. The record data dividing circuit 24 extracts and reforms the record data for one line to supply it to the recording head driver IC26.

Figure 4:
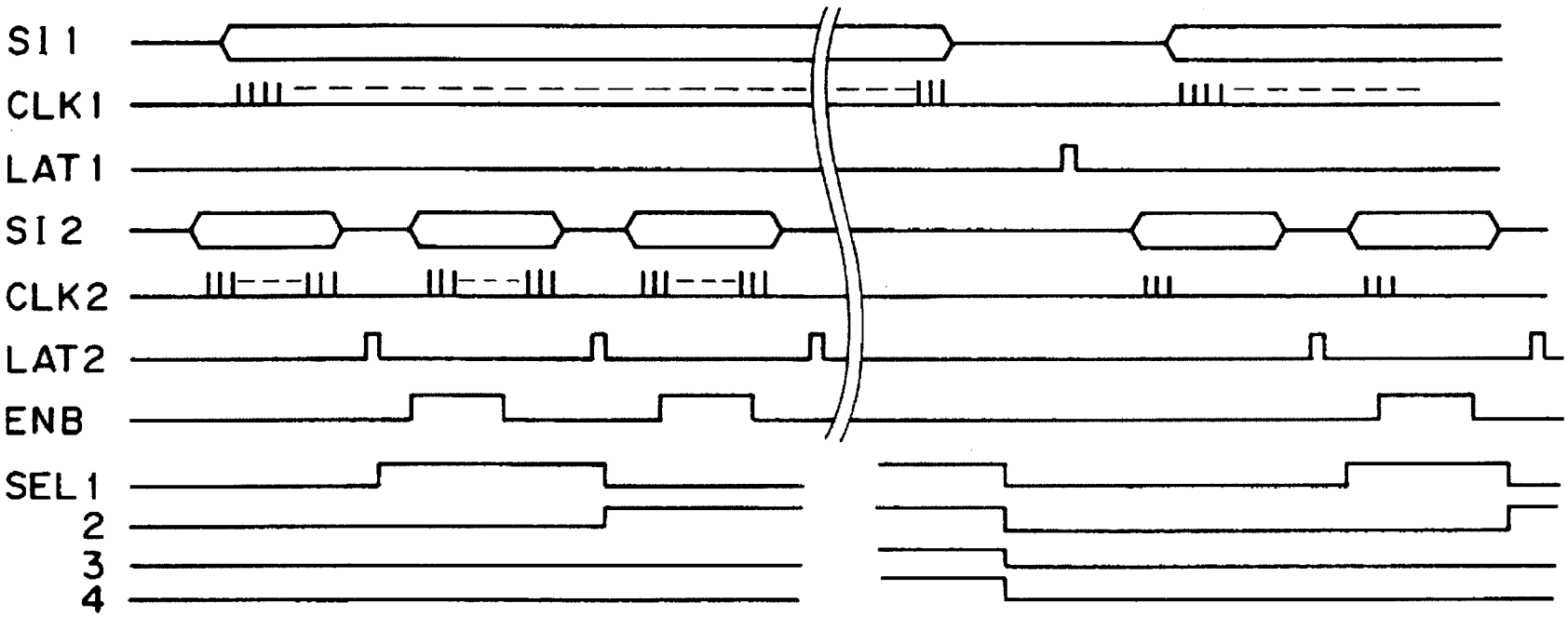
FIG. 4 is a drive timing chart corresponding to the circuit of FIG. 3.

FIG. 4 shows the drive timing in this embodiment. The record data SI1 for one line constituted by the same bit number as the number of electrothermal transducer elements are reintroduced into record data SI2 corresponding to the electrothermal transducer elements which are simultaneously driven by the record data dividing circuit, and are transferred to the recording head. Thereafter, the data are read in the latching circuit in the driver IC selected by the selection signals SEL1–SEL4 in accordance with the input of the latching signal LAT2. Then, the electrothermal transducers selected by the input of the ENB signal are supplied with the electric energy. The data transfer, selection signal application and the pulse width setting signal application are repeated for a predetermined number of times to effect the printing for one line.

Figure 1A:
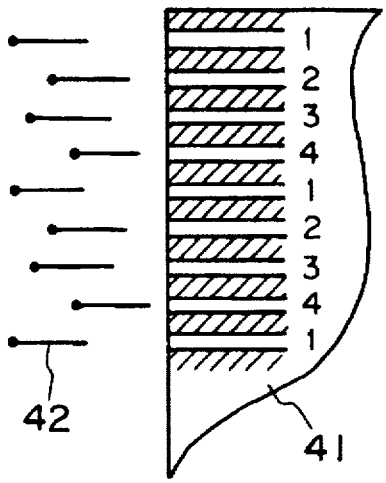
FIG. 1A is a sectional view of a recording head illustrating the time sharing drive.
Figure 1B:
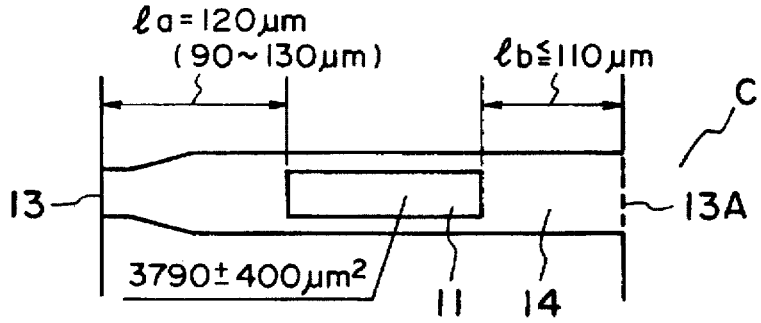
FIG. 1B shows the structure of the liquid passage communicating with a common liquid chamber.
Figure 2:
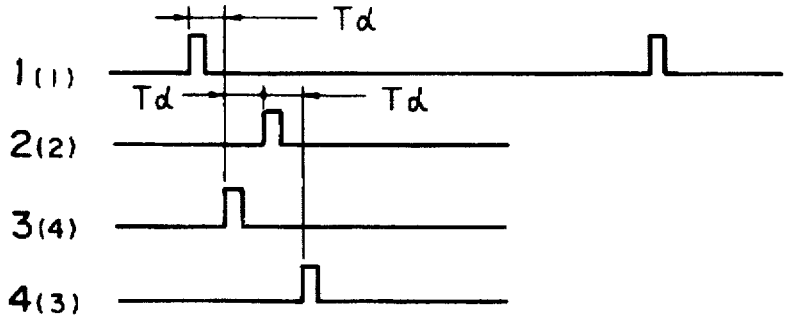
FIG. 2 is a timing chart illustrating the timing of the drive signals.

Referring to FIGS. 1A, 1B and 2, the major part of the embodiment of this invention will be described. The ink jet recording head 41 ejects the ink droplet along a path 42. In the Figure, the nozzles of the ink jet recording head is grouped into four groups. As shown in FIG. 2 by the driving pulses, the electrothermal transducers for the passages are sequentially driven with the time difference Td in the order of No. 1, No. 3, No. 2 and No. 4. The numerals in the parentheses in FIG. 2 designate the order of drive in each of the groups of electrothermal transducer element. In this embodiment, the first electrothermal transducer is driven; and then the third electrothermal transducer is driven (time difference Td between adjacent pulses). With the same timing, the second electrothermal transducer is driven, and the fourth electrothermal transducer is driven. Therefore, adjacent electrothermal transducers are not driven within each of the groups and between adjacent groups.

FIG. 1B is a sectional view of an ink passage of an ink jet recording head, showing a planar heat generating element 11, wherein the ejection outlet is smaller than the liquid passage in the cross-sectional area. In the Figure, the area of the heat generating element is 3790.5 micron$^2$ (133×28.5), for example. A distance La from a downstream end of the heat generating element to the orifice with respect to the direction of ejecting flow of the ink, is 120 microns. The recording head is of a type wherein the direction of the ejection of the ink is substantially parallel with the heat generating surface. However, when they are not parallel, the present invention applies by defining the distance La as the minimum distance between the ejection outlet 13 and the heat generating element 11. As will be understood, the definition is generic to both of the types. A distance form an upstream end of the heat generating element to an upstream end of the ink passage (supply port 13A) Lb with respect to the direction of the flow of the ejecting ink has been found to be significantly influential to the frequency of the recording droplet formations, and therefore, the printing speed.

The distance Lb is the minimum distance between the supply port 13A and the heat generating element 11.

Figure 5:
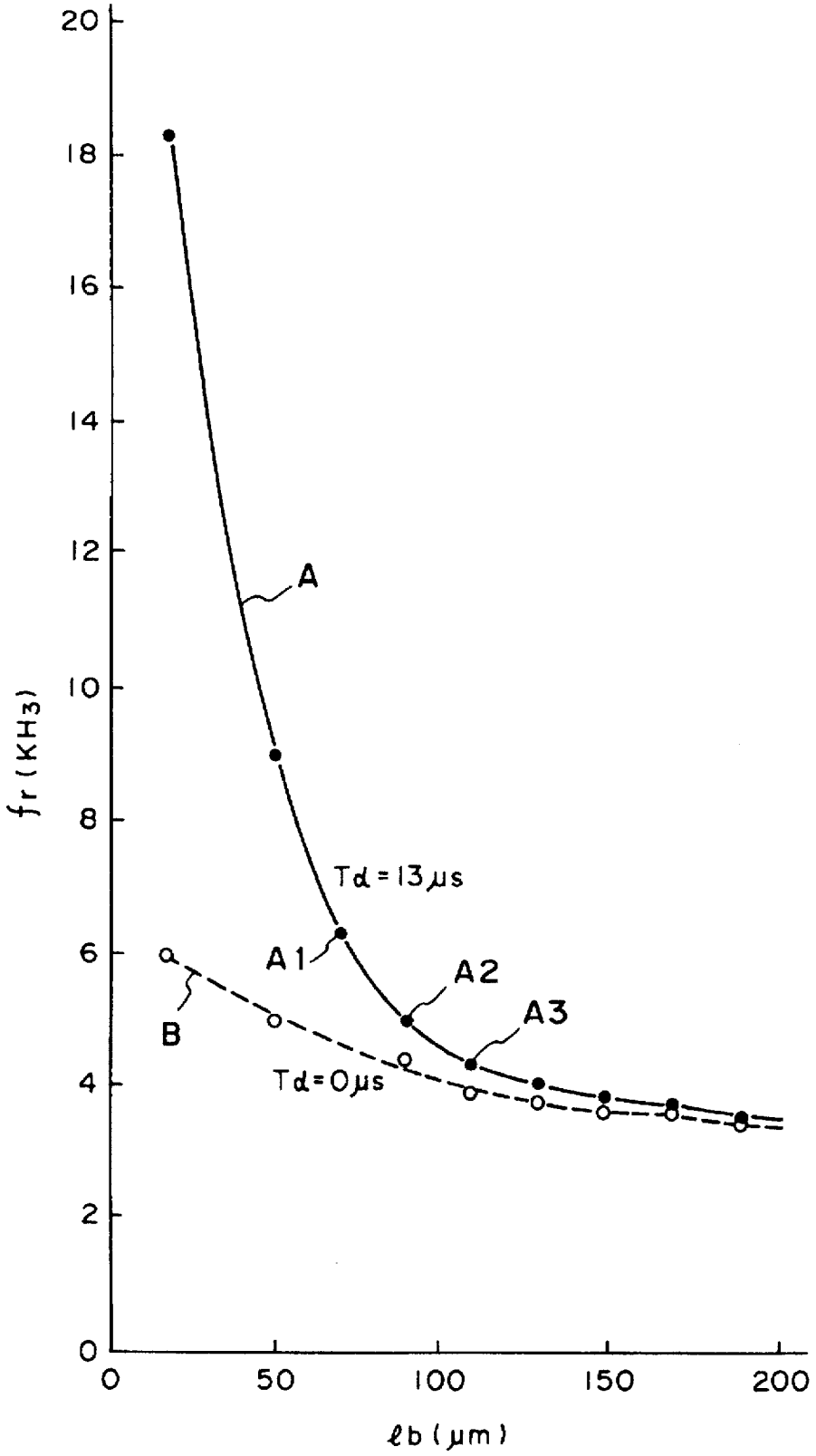
FIG. 5 is a graph illustrating the advantageous effect of the embodiment of the present invention.

Referring to FIG. 5, the description will be made as to the distance Lb. FIG. 5 is a graph showing a relation between a meniscus restoring frequency $f_r$ (refilling frequency) and the distance Lb when all of the nozzle are simultaneously actuated or driven. The solid line in this graph represents the frequency $f_r$ when the heat generating elements of FIG. 1 are sequentially driven in the order of the arrangement thereof with the rest period Td 13 micro-sec in the time sharing drive. The broken line in the graph represents the frequency $f_r$ when the time difference Td is 0, that is, the heat generating elements are driven in a non-time-sharing fashion.

It will be understood from this Figure that the frequency $f_r$ increases with decrease of the distance Lb, and particularly that the frequency $f_r$ abruptly increases in the region Lb≦110 microns. Additionally, the frequency $f_r$ can be significantly increased by using the time difference Td=13 micro-sec, as compared with the simultaneous drive. This is because of the crosstalk among the nozzles. The increase rate by using the time sharing drive is larger if the distance Lb is shorter, that is, the influence of the crosstalk is stronger.

On the line A, a plot A1 indicates 6.3 KHz at 70 microns; A2, 5 KHz at 90 microns; A3, 4.35 KHz at 110 microns. The tendency is similar in the case of the driving order shown in FIGS. 7A and 2.

From the foregoing, it will be understood that in the ink jet recording head driven in the time sharing fashion for the adjacent nozzles, the frequency $f_r$ is increased, and that the frequency is a significantly increased by satisfying Lb≦110 microns, so that the recording speed is remarkably improved.

Further preferably, the distance Lb is not more than 70 microns, since then the frequency is larger than the frequency in the case of the simultaneous driving. The distance La is preferably 120 microns in this case.

The description will be made as to the distance La. It has been found that there is an optimum distance La. If the distance La is much smaller than 130 microns, the following problems arise:

(1) When the meniscus retracts after the ejection of the recording liquid, the bubble which is in the process of collapsing contacts the meniscus with the result that the external gases are introduced into the nozzle, which leads to liquid ejection failure; and this occurs in a time period of 25–35 micro-sec from the application of the ejecting pulse:

(2) When the size of the bubble reaches its maximum, the leading edge of the bubble penetrates through the orifice with the result of introduction of the external gases into the nozzle, which leads to ejection failure; and this occurs in a time period of 5–15 micro-sec from application of the ejection pulse energy.

The above phenomena occur in the region of La <90 microns, and therefore, the distance La is preferably not less than 110 microns.

When the distance La is much larger than 130 microns, the following problems arise:

(1) The impedance against flow of the recording liquid in the ejecting direction from the center of the heater is increased with the result of decreased ejection speed of the recording liquid, which leads to the degrading of the accuracy in the position of the shot of the liquid on the recording medium and therefore to the deterioration of the quality of the image recorded; and (2) The above increase of the impedance results in the lower quantity of the ejected recording liquid, with the result of the lower image density of the print on the recording medium, and therefore, the deterioration of the image quality.

The phenomena occur in the region of La>130 microns, and therefore, the distance La is preferably not more than 130 microns.

As regard the relation between the distances La and Lb, the distance La is preferably larger than the distance Lb, since then, the quantities of the ejected liquid is uniform.

Further preferably, all of the above-described conditions La>Lb, 90≦La≦130 (microns) and Lb ≦110 (microns) are satisfied, since then all of the above advantageous effects are provided.

Figure 6A:
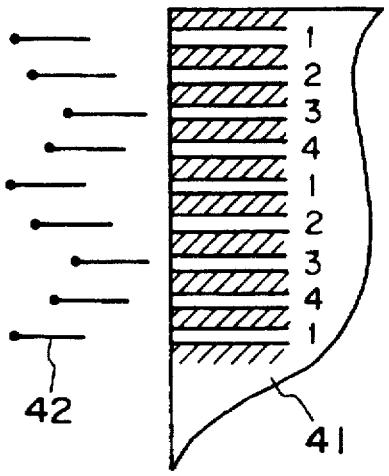
FIGS. 6A is a sectional view of a recording head according to another embodiment of the present invention wherein the recording head is driven by a time-shared manner.
Figure 6B:
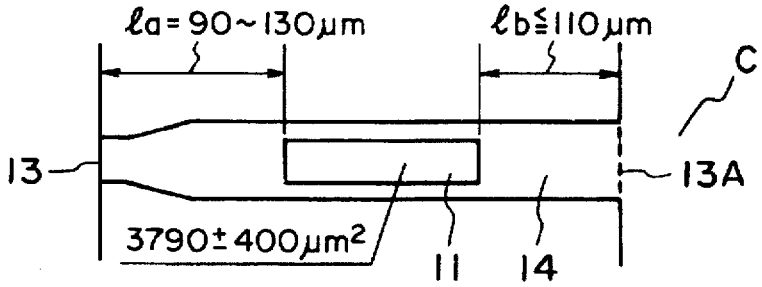
FIGS. 6B shows a liquid passage communicating with a common chamber.
Figure 7:
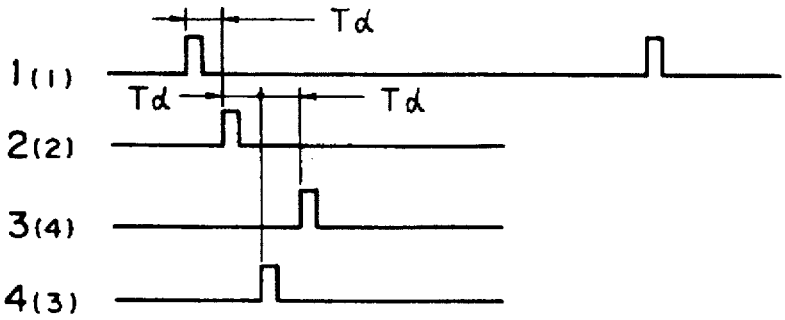
FIG. 7 is timing chart illustrating the timing of the driving signals.

FIGS. 6A and 6B and 7 are similar to FIGS. 1A and 1B and FIG. 2, with the exception that the manner of applying the driving signal to the electrothermal transducers are different. In this embodiment, the electrothermal transducers designated by Nos. 1, 2, 3 and 4, are driven in the order of 1, 2, 4 and 3.

Similarly to the foregoing embodiment, the distance Lb is not more than 110 microns, and La>Lb is satisfied. With the time shared driving in this manner, the frequency $f_r$ is increased, and in addition by satisfying Lb≦110 microns, the frequency is further remarkably increased, and therefore, the recording speed is remarkably increased.

The advantageous effects of the present invention are provided even if the sequentially driven electrothermal transducers are not adjacent, but if they are closely arranged (nozzles 1 and 3, 2 and 4 in FIGS. 7A and 7C; nozzles 2 and 4 in FIGS. 8A and 8C). The advantageous effects are remarkable particularly when the distance between centers of the heat generating portions of the electrothermal transducers simultaneously driven is not more than 100 microns, further particularly when it is not more than 80 microns.

The advantage of the present invention increases with increase of the number of groups of liquid passages and therefore electrothermal transducers. Particularly when the number of groups is not less than 48, the difference between the simultaneous drive and the drive in accordance with the present invention is remarkable. Also, the present invention is particularly advantageous when the ejection outlets are arranged at high density. From the standpoint of the stabilization of the ejecting performance, the heat generating surface area of the heat generating element is preferably not more than 4190 micron$^2$ and not less than 3390 micron$^2$.

The description will be made as to the apparatus capable of continuously operating for very long period in a stabilized manner. When the distance Lb is very small, the vibration of the meniscus resulting from the restoring the meniscus to the orifice after the ejection of the recording liquid increases, by which the orifice is wetted with the liquid in some cases after long term recording operation. If this occurs, the straight directivity of the recording liquid is deteriorated by the wetting with the result that the accuracy in the positions of the shot deposition on the recording material is slightly deteriorated. In order to stabilize the recording liquid ejection by avoiding the above, it has been found that Lb≧40 microns is preferable. In addition, it is preferable that the configuration of the passage is the same as shown in FIG. 1 from the inlet port to the heat generating element.

In the case of the nozzle having a flow resistance element upstream of the heat generating element for reducing the ink passage area for the purpose of flow of the ink toward upstream, the printing quality is guaranteed over a range having a smaller distance Lb, as compared with the nozzle shown in FIG. 1B, by the increase of the impedance by the flow resistance element. More particularly, if Lb≧30 microns, the good printing is assured for a long period of time at a high printing speed.

The driving pulse of the driving signal in this embodiment preferably has the major disclosed in U.S. Pat. Nos. 4,463,359 and 4,345,262. Further preferably, the conditions disclosed in U.S. Pat. No. 4,313,124 relating to the temperature increase of the heat generating surface are used.

The advantageous effects of the present invention are significant when the present invention is used in a full-line type recording head. The full-line recording head may be of a type of plural recording heads covering as a whole the entire length of the maximum recording line, and a type wherein one recording head covers the entire line.

The present invention is applicable to the recording head of a exchangeable chip type wherein when the chip is mounted, it is electrically connected with the apparatus and it is capable of being supplied with the recording liquid from the main apparatus, or a cartridge type recording head having an ink supply source.

The present invention is particularly advantageously usable with an ink jet recording apparatus or head wherein the print data to the plural electrothermal transducer elements are divided and transferred for each plurality of bits, and the adjacent electrothermal transducers are driven with time difference sequentially.

As described in the foregoing, according to the present invention, the actuatable recording frequency can be increased, and therefore, the recording speed can be increased.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus, comprising:

at least 48 liquid passages, each said passage having an ejection outlet through which a droplet of the liquid is ejected, at an end of the liquid passage, and each of the passages being supplied with ink only from the other end through a supply port;

a common ink chamber for containing the ink, with which said liquid passages communicate at different said supply ports of said passages;

electrothermal transducer elements each having a planar heat generating element in each of said liquid passages, said electrothermal transducer element being supplied with an electric signal to produce a state change of the ink including formation of a bubble in the liquid passage due to thermal energy, wherein a minimum distance La between each of the heat generating elements and the corresponding ejection outlet is not less than 90 microns and not more than 130 microns, a minimum distance Lb between each of the heat generating elements and the corresponding said supply port is not more than 110 microns, and the distances La and Lb satisfy La>Lb;

a driving circuit for energizing said heat generating elements, said driving circuit supplying the electric signals so that adjacent ones of said heat generating elements are driven with a time difference.

2. An apparatus according to claim 1, wherein the number of said liquid passages is not less than 48, and said liquid passages are straight, and wherein a heat generating area of each of said heat generating elements is not less than 3390 micron$^2$ and not more than 4190 micron$^2$.

3. An apparatus according to claim 1, further comprising a driving source for driving said driving circuit.

4. An ink jet recording apparatus, comprising:

at least 48 liquid passages, each said passage having an ejection outlet through which a droplet of the liquid is ejected, at an end of the liquid passage, and each of the passages being supplied with ink only from the other end through a supply port;

a common ink chamber for containing the ink, with which said liquid passages communicate at different said supply ports of said passages;

electrothermal transducer elements each having a planar heat generating element in each of said liquid passages, said electrothermal transducer element being supplied with an electric signal to produce a state change of the ink including formation of a bubble in the liquid passage due to thermal energy, wherein said heat generating elements each have a heat generating area which is not less than 3390 micron$^2$ and not more than 4190 micron$^2$, a minimum distance La between each of the heat generating elements and the corresponding ejection outlet is not less than 90 microns and not more than 130 microns, a minimum distance Lb between each of the heat generating elements and the corresponding said supply port is not more than 110 microns, and the distances La and Lb satisfy La>Lb;

a driving circuit for energizing said heat generating elements, said driving circuit supplying the electric signals so that adjacent ones of said heat generating elements are driven with a time difference.

5. An apparatus according to claim 4, wherein said heat generating elements are grouped into plural groups, and said driving circuit drives said heat generating elements in a group sequentially.

6. An apparatus according to claim 4, wherein the minimum distance Lb is not less than 30 microns, and said liquid passage is each provided with a flow resistance element disposed between the heat generating element and the supply port.

7. An apparatus according to claim 4, wherein the minimum distance Lb is not less than 40 microns, and said liquid passage has the same cross-sectional configuration between said heat generating element and the supply port.

8. An apparatus according to claim 4, wherein the minimum distance Lb is not more than 70 microns.

9. An apparatus according to claim 4, wherein the ejection outlet has an area which is smaller than that of said liquid passage where the heat generating element is disposed.

10. An apparatus according to claim 4, further comprising a driving source for driving said driving circuit.

11. An ink jet recording apparatus, comprising:

at least 48 ink passages, each said passage having a respective ejection outlet through which ink is ejected, each said ink passage having a supply port;

a common ink chamber communicating with said supply ports of said plural ink passages;

heat generating elements, disposed in the respective ink passages, for producing thermal energy contributable to ejecting the ink;

means for sequentially supplying signals for producing the thermal energy to adjacent or closely disposed ones of said heat generating elements;

wherein a distance Lb between each said supply port and that end of said heat generating element which is closer to the supply port is not more than 110 microns, and wherein a distance La between the ejection outlet and that of said heat generating element which is closer to the ejection outlet satisfies La>Lb.

* * * * *

UNITED STATES PATENT AND TRADEMARK OFFICE

CERTIFICATE OF CORRECTION

PATENT NO. : 5,726,697

DATED : March 10, 1998

INVENTOR(S) : JUNJI SHIMODA

It is certified that error appears in the above-identified patent and that said Letters Patent is hereby corrected as shown below:

COLUMN 1

Line 25, "state of change" should read --change of state--.

COLUMN 2

Line 4, "resolved" should read --dissolved--.
Line 42, "the" should read --as the--.

COLUMN 3

Line 58, "FIGS. 6A" should read --FIG. 6A--.
Line 60 "by" should read --in--.
Line 61, "FIGS. 6B" should read --FIG. 6B--.

COLUMN 4

Line 9, "electrothermai" should read --electrothermal--.
Line 63, "element" should read --elements--.

COLUMN 5

Line 17, "form" should read --from--.
Line 28, "nozzle" should read --nozzles--.
Line 32, "micro-sec" should read --microseconds--.

UNITED STATES PATENT AND TRADEMARK OFFICE

CERTIFICATE OF CORRECTION

PATENT NO. : 5,726,697

DATED : March 10, 1998

INVENTOR(S) : JUNJI SHIMODA

It is certified that error appears in the above-identified patent and that said Letters Patent is hereby corrected as shown below:

COLUMN 5

Line 42, "micro-sec" should read --microseconds--.
Line 44, "rate" should read --in the rate--.

COLUMN 6

Line 4, "micro-sec" should read --microseconds--.
Line 9, "micro-sec" should read --microseconds--.
Line 32, "regard" should read --regards--.

Signed and Sealed this

Sixth Day of October, 1998

*Attest:*

*Attesting Officer*

BRUCE LEHMAN

*Commissioner of Patents and Trademarks*